US005425290A

United States Patent [19]

Fought et al.

[11] Patent Number: 5,425,290

[45] Date of Patent: Jun. 20, 1995

[54] DOORSTOP INSTALLATION WRENCH

[76] Inventors: Kim Fought; William E. Fought, both of 14475 Minnetonka Cr., Reno, Nev. 89511

[21] Appl. No.: 175,631

[22] Filed: Dec. 30, 1993

[51] Int. Cl.[6] ..... B25C 3/00; B25B 13/06

[52] U.S. Cl. ..... 81/44; 81/124.2; 81/125

[58] Field of Search ..... 81/44, 487, 121.1, 125, 81/124.2, 124.4, 451, 177.1

[56] References Cited

U.S. PATENT DOCUMENTS

| | | | |
|---|---|---|---|
| 798,325 | 8/1905 | Daddysman, Jr. | 81/124.2 X |
| 2,106,712 | 2/1938 | Bertrand | 81/124.2 X |
| 2,993,397 | 7/1961 | Albertson et al. | 81/125 |
| 4,393,583 | 7/1983 | Zwald | 81/124.2 X |
| 4,724,731 | 2/1988 | Onofrio | 81/124.2 X |
| 5,035,162 | 7/1991 | Dougherty | 81/124.4 |
| 5,048,378 | 9/1991 | Nikolas | 81/124.2 |
| 5,335,569 | 8/1994 | Rowley | 81/125 |

*Primary Examiner*—D. S. Meislin

[57] ABSTRACT

A specialized wrench for a power tool which makes installation quick and does not mark the paint when installing doorstops.

1 Claim, 3 Drawing Sheets

DOORSTOP INSTALLATION WRENCH

BACKGROUND OF THE INVENTION

1. Field of The Invention

The invention relates generally to the field of wrenches, sockets and tools.

2. Description of The Prior Art

Doorstops are commonly used to protect walls from being marked by door knobs. These stop devices are known to the prior art. They usually include a protrusion similar to a wood screw. This wood screw is usually driven by a hexagonal nut flange near where it would attach to a wall. The stop can't be driven from the end opposite the screw unless it is rigid. Most now incorporate a spring and mar resistant tip for energy absorption. Because the stops are designed in their unique fashion the present state of the art dictates the use of a box end wrench to install the stop. This is very time consuming and risks marring the paint jobs on new houses. The stops are installed after painting to avoid costly masking.

The present invention overcomes the shortfalls of the prior art by introducing a specialized wrench for a power tool which makes installation quick and does not mark the paint. This invention drives the two standard doorstops.

OBJECTS OF THE INVENTION

A first object of the invention is to provide a wrench for quick installation of standard doorstops.

A second object of the invention is to provide a wrench to install doorstops without marring the baseboards on which they are to be installed.

A third object of the invention is to provide a wrench which has an open box end but can use a power driver.

SUMMARY OF THE INVENTION

A device having a cylinder with a mandrel for attaching a driver and an opening for a nut flange on the opposite end.

DESCRIPTION OF PREFERRED EMBODIMENTS

Figure 1:
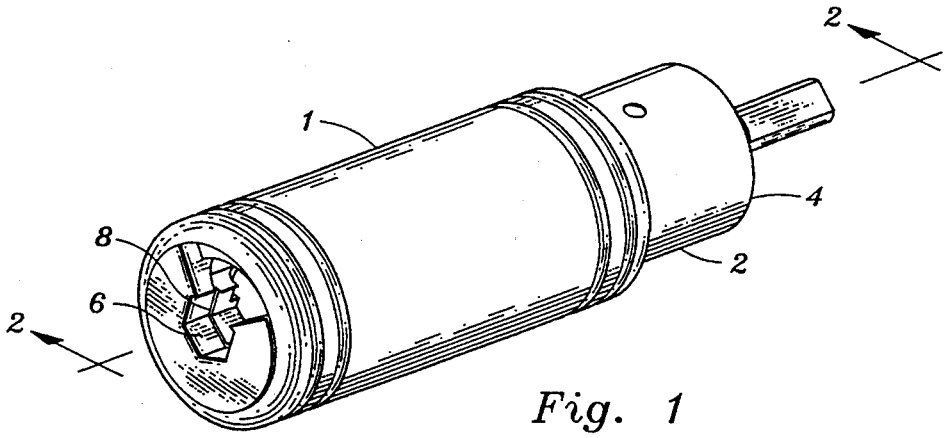
FIG. 1 is a perspective view of the wrench

FIG. 1 shows the handle 1 which is coaxially aligned with the inner sleeve 2 but can rotate and slide with respect thereto. Thus when the inner sleeve 2 is attached to a rotary power tool 9 the operators hand can hold handle 1 to guide the placement and angle of the doorstop 3. The handle 1 is spring biased away from the mandrel end 4 of the inner sleeve 2, but can be slide toward the mandrel 4 to allow the doorstop 3 to ingress/egress the chamber 5 of the inner sleeve 2.

The inner sleeve 2 has an open chamber 5 to receive the door stop 3 and at an end opposite the mandrel end 4 the inner sleeve has a hexagonal slot 6 for holding the hexagonal protrusion 7 of the door stop 3. The slot 6 has a step 8 for receiving at least two different sizes of hexagonal protrusions 7. Further slot 6 is open radially approximately 90° to facilitate ingress/egress of the doorstop 3 relative to the inner sleeve 2.

Figure 10:
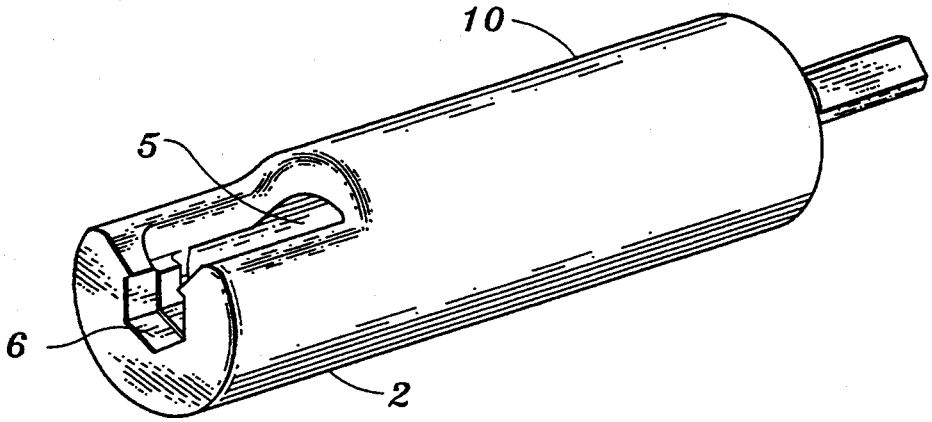
FIG. 10 is a perspective view of another embodiment

FIG. 10 shows an alternate embodiment where the handle is not present and the operator holds the inner sleeve 2 at 10.

Figure 2:
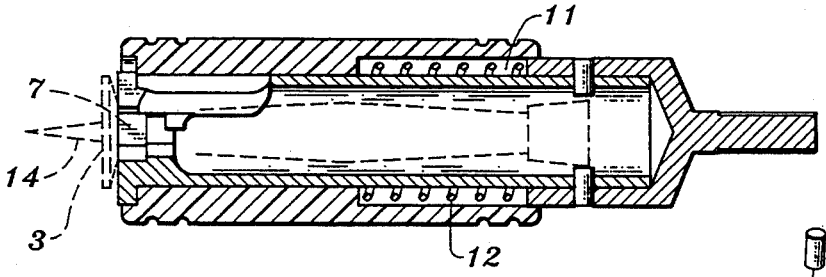
FIG. 2 is a sectional view of the wrench

FIG. 2 shows a sectional view of the doorstop 3 disposed in the chamber 5 and the recess 11 for the spring 12 which biases the handle toward the doorstop 3.

Figure 3:
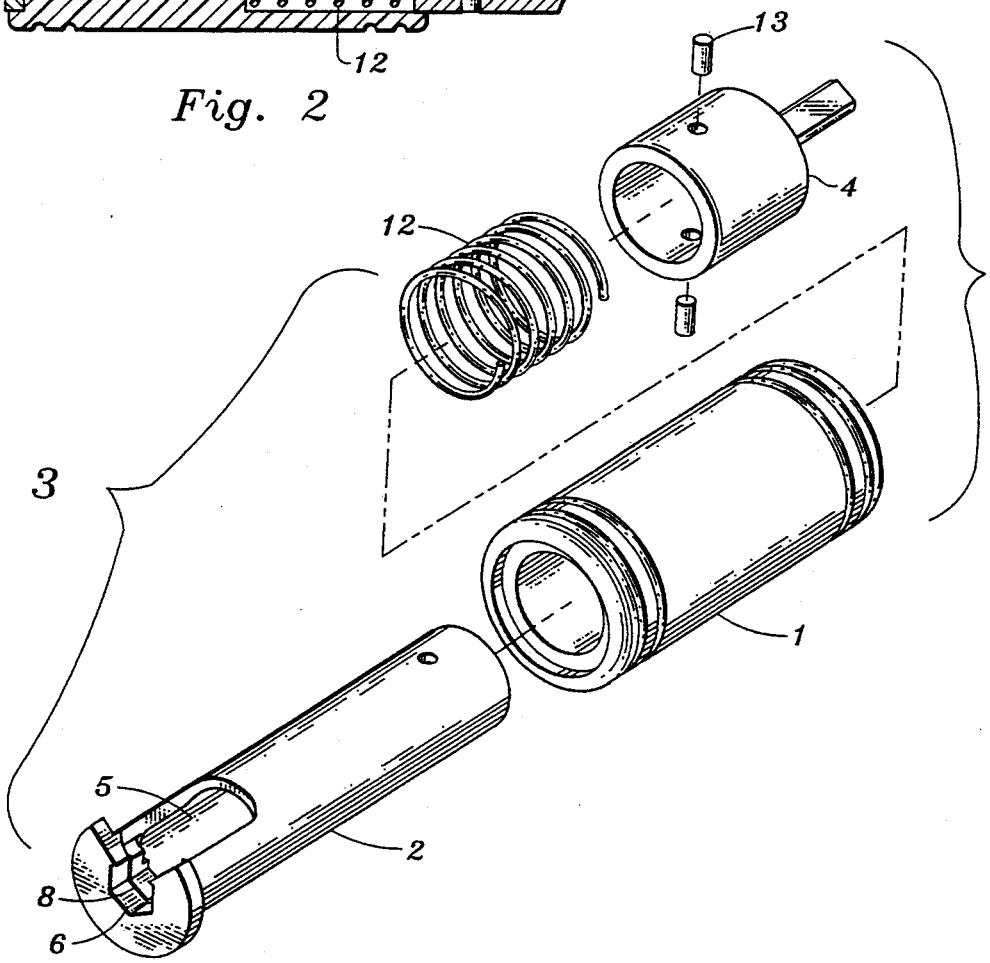
FIG. 3 is a exploded view of the wrench
Figure 4:
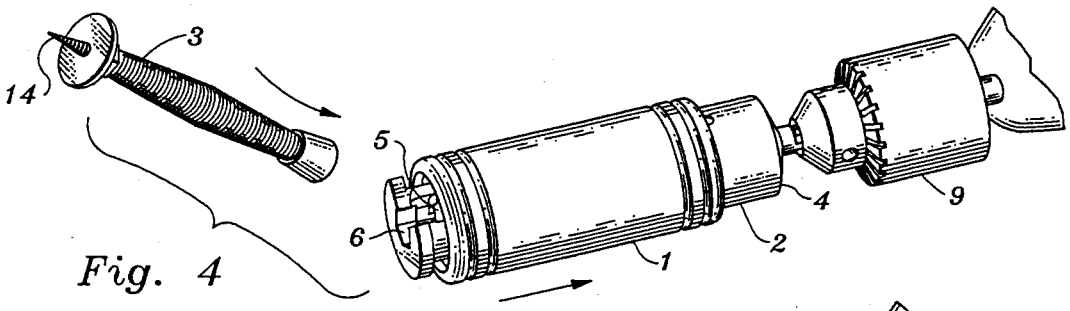
FIG. 4 is a perspective view of the wrench and doorstop
Figure 5:
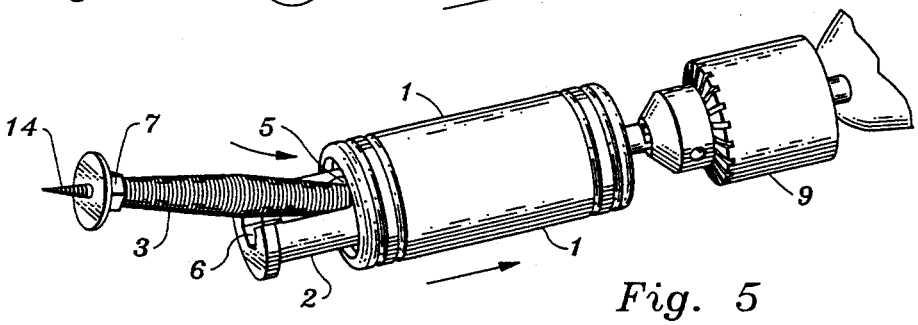
FIG. 5 is a perspective view of the wrench with the handle retracted and the doorstop inserted
Figure 6:
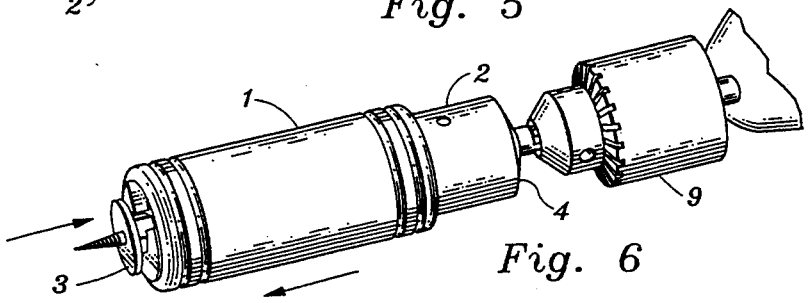
FIG. 6 is a perspective view with the doorstop held in place
Figure 7:
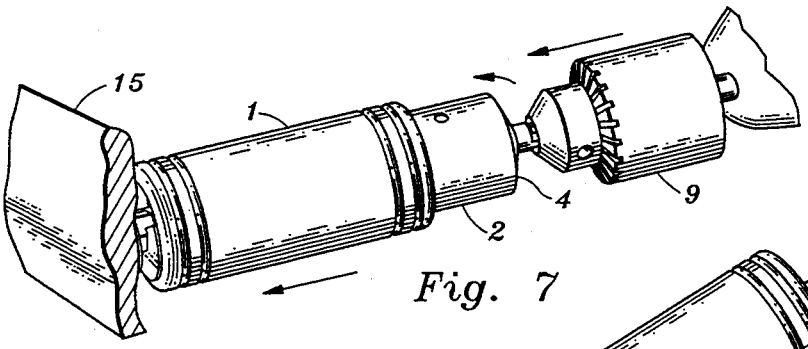
FIG. 7 is a side view of the wrench driving the doorstop into a wall
Figure 8:
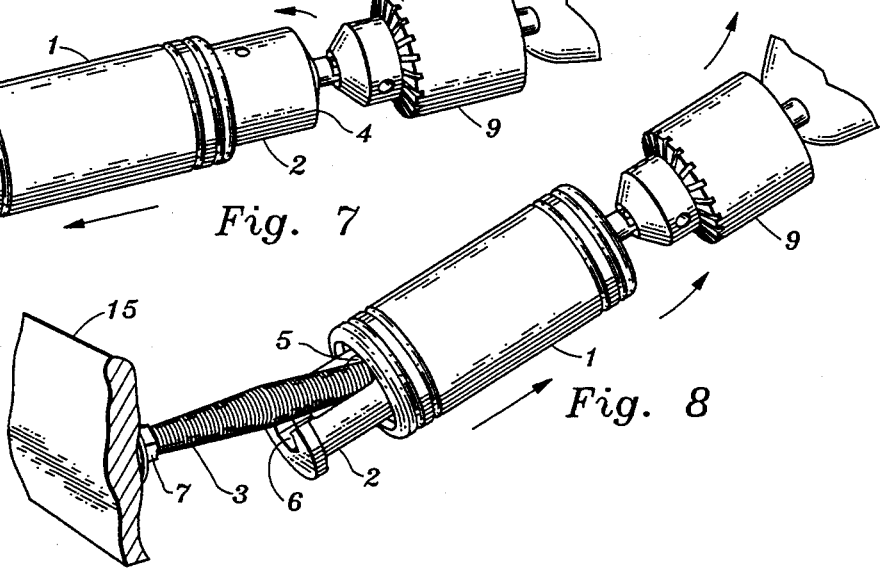
FIG. 8 is a perspective view of the doorstop being disengaged from the wrench

FIG. 3 shows an exploded view of the device which more clearly shows the dowel 13 construction.

FIGS. 4–8 shows the operation of the device. The handle 1 is slid away from the hexagonal slot 6 to allow ingress of the doorstop 3 into the inner chamber 5. After the nut like flange 7 enters the slot 6 or 8 depending upon size, the handle 1 is released and springs over the inner chamber to rotate freely with respect to the cylindrical inner sleeve 2. The screw 14 is driven into a mounting surface 15. The handle 1 is again retracted to allow egress of the doorstop when mounted to the mounting surface. The mounting surface can be the door, the wall or the foot board.

Figure 9:
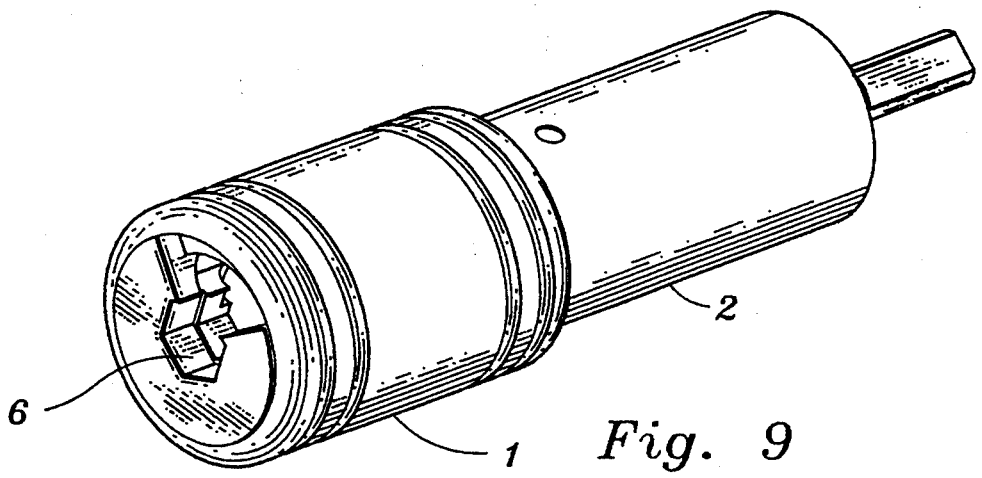
FIG. 9 is a perspective view of another embodiment

FIG. 9 shows an alternate embodiment having a shorter handle portion which may prove to reduce production costs.

Obviously many modifications and variations of the present invention are possible in light of the above teachings. It is therefor to be understood that within the scope of the appended claims, the invention may be practiced other than as specifically described.

What is claimed and desired to be protected by Letters Patent of the U.S. is:

1. A device comprising: a first cylinder, a mandrel, a drive means and a cylindrical handle, said cylindrical handle disposed coaxially over said first cylinder, said first cylinder having said mandrel at a first end for attaching said drive means, said first cylinder having an opening for receiving a nut at an end opposite said mandrel, said opening extending over a portion of a radial arc of said end opposite said mandrel and a portion of a wall of said first cylinder to allow egress from said cylinder by an object to be driven, said opening having means for receiving multiple nut sizes and bias means to force said cylindrical handle over said opening in said wall of said first cylinder.

* * * * *